US007991443B2

(12) United States Patent
Chiang

(10) Patent No.: US 7,991,443 B2
(45) **Date of Patent: *Aug. 2, 2011**

(54) SLIDING HINGE

(75) Inventor: Chen-Wei Chiang, Shulin (TW)

(73) Assignee: Shin Zu Shing Co., Ltd., Shulin, Taipei Hsien (TW)

( * ) Notice: Subject to any disclaimer, the term of this patent is extended or adjusted under 35 U.S.C. 154(b) by 764 days.

This patent is subject to a terminal disclaimer.

(21) Appl. No.: 12/025,461

(22) Filed: Feb. 4, 2008

(65) Prior Publication Data

US 2009/0193620 A1 Aug. 6, 2009

(51) Int. Cl.
*E05D 7/00* (2006.01)

(52) U.S. Cl. ..... 455/575.4; 16/284; 16/327; 455/575.1; 455/575.2; 455/575.3; 455/550.1

(58) Field of Classification Search ..... 455/575.4, 455/575.1–575.3, 550.1; 16/327, 284; D14/138
See application file for complete search history.

(56) References Cited

U.S. PATENT DOCUMENTS 7,385,150 B1 * 6/2008 Siddiqui et al. ..... 200/5 A
7,529,571 B2 * 5/2009 Byun et al. ..... 455/575.4
7,653,422 B2 * 1/2010 Roberts ..... 455/575.4
2006/0030381 A1 * 2/2006 Byun et al. ..... 455/575.4
2006/0079301 A1 * 4/2006 Kim et al. ..... 455/575.3
2007/0032278 A1 * 2/2007 Lee et al. ..... 455/575.4
2007/0155451 A1 * 7/2007 Lee ..... 455/575.4
2007/0243912 A1 * 10/2007 Lee et al. ..... 455/575.4
2008/0052874 A1 * 3/2008 Liu ..... 16/246
2008/0139260 A1 * 6/2008 Kauhaniemi et al. ..... 455/575.4
2009/0011805 A1 * 1/2009 Eaton ..... 455/575.4
2009/0151119 A1 * 6/2009 Shen ..... 16/308
2009/0183340 A1 * 7/2009 Chiang ..... 16/327

* cited by examiner

*Primary Examiner* — Jinsong Hu
*Assistant Examiner* — Qun Shen
(74) *Attorney, Agent, or Firm* — Duane Morris LLP; J. Rodman Steele, Jr.; Gregory M. Lefkowitz

(57) ABSTRACT

A sliding hinge is mounted in an electronic device and has a stationary bracket, a sliding bracket and a resilient element. The stationary bracket connects to a base of the electronic device. The sliding bracket connects to a cover of the electronic device, is mounted slidably on the stationary bracket and has a body. The resilient element is mounted between the stationary bracket and the body of the sliding bracket to provide effectively friction to maintain the cover at any desired position. With the positioning holes and the positioning protrusions are formed on the stationary bracket and the sliding bracket to simplify the assembling procedure.

4 Claims, 5 Drawing Sheets

SLIDING HINGE

BACKGROUND OF THE INVENTION

1. Field of the Invention

The present invention relates to a sliding hinge, especially to a sliding hinge with positioning elements mounted between a cover and a base of an electronic device.

2. Description of the Prior Arts

Sliding-design electronic devices including cell phones, PDAs or the like comprise a cover with a display, a base with a keyboard and main electronic elements, and a conventional sliding hinge. The conventional sliding hinge is mounted between the cover and the base to allow the cover sliding relative to the base.

The conventional sliding hinge comprises a stationary bracket, a sliding bracket, a resilient element and a positioning element. The stationary bracket has two sliding channels and multiple positioning holes. The sliding bracket has two extensions respectively mounted slidably in the sliding channels. The resilient element is mounted between the extensions and the bottom of the stationary bracket to provide friction to maintain the cover at any desired position. The positioning element is mounted between the stationary bracket and the sliding bracket and has a positioning protrusion selectively engaging the positioning holes of the stationary bracket to provide positioning function.

However, the conventional sliding hinge has following disadvantages:

1. The resilient element and the positioning element are two independent elements. The resilient and positioning elements have no connecting segments but have to maintain at corresponding position. The assembling of the resilient and positioning elements only relies on the pressing of the stationary and sliding brackets. Therefore, the assembling of the conventional sliding hinge is complicated and hard.

2. The resilient element is used to provide friction but only contacts with the extensions of the sliding bracket. The small contacting surface causes the sliding bracket slides unstably relative to the stationary bracket and also limits the providing friction.

To overcome the shortcomings, the present invention provides a sliding hinge to mitigate or obviate the aforementioned problems.

SUMMARY OF THE INVENTION

The main objective of the present invention is to provide a sliding hinge that simplifies assembling procedure and effectively provides friction. The sliding hinge is mounted in an electronic device and has a stationary bracket, a sliding bracket and a resilient element. The stationary bracket connects to a base of the electronic device. The sliding bracket connects to a cover of the electronic device, is mounted slidably on the stationary bracket and has a body. The resilient element is mounted between the stationary bracket and the body of the sliding bracket to provide effectively friction to maintain the cover at any desired position. With the positioning holes and the positioning protrusions are formed on the stationary bracket and the sliding bracket to simplify the assembling procedure.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
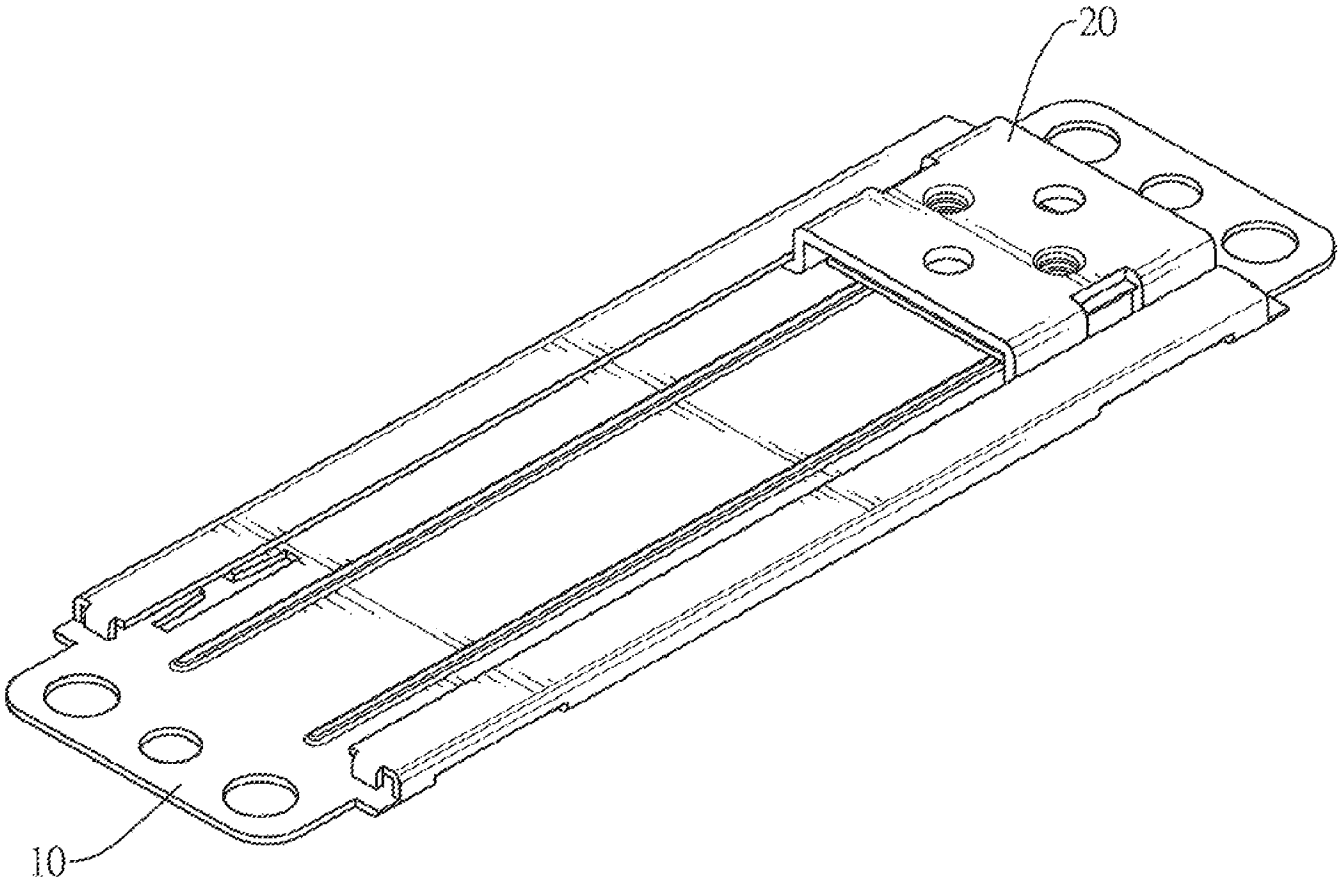
FIG. 1 is a perspective view of a sliding hinge in accordance with the present invention.
Figure 2:
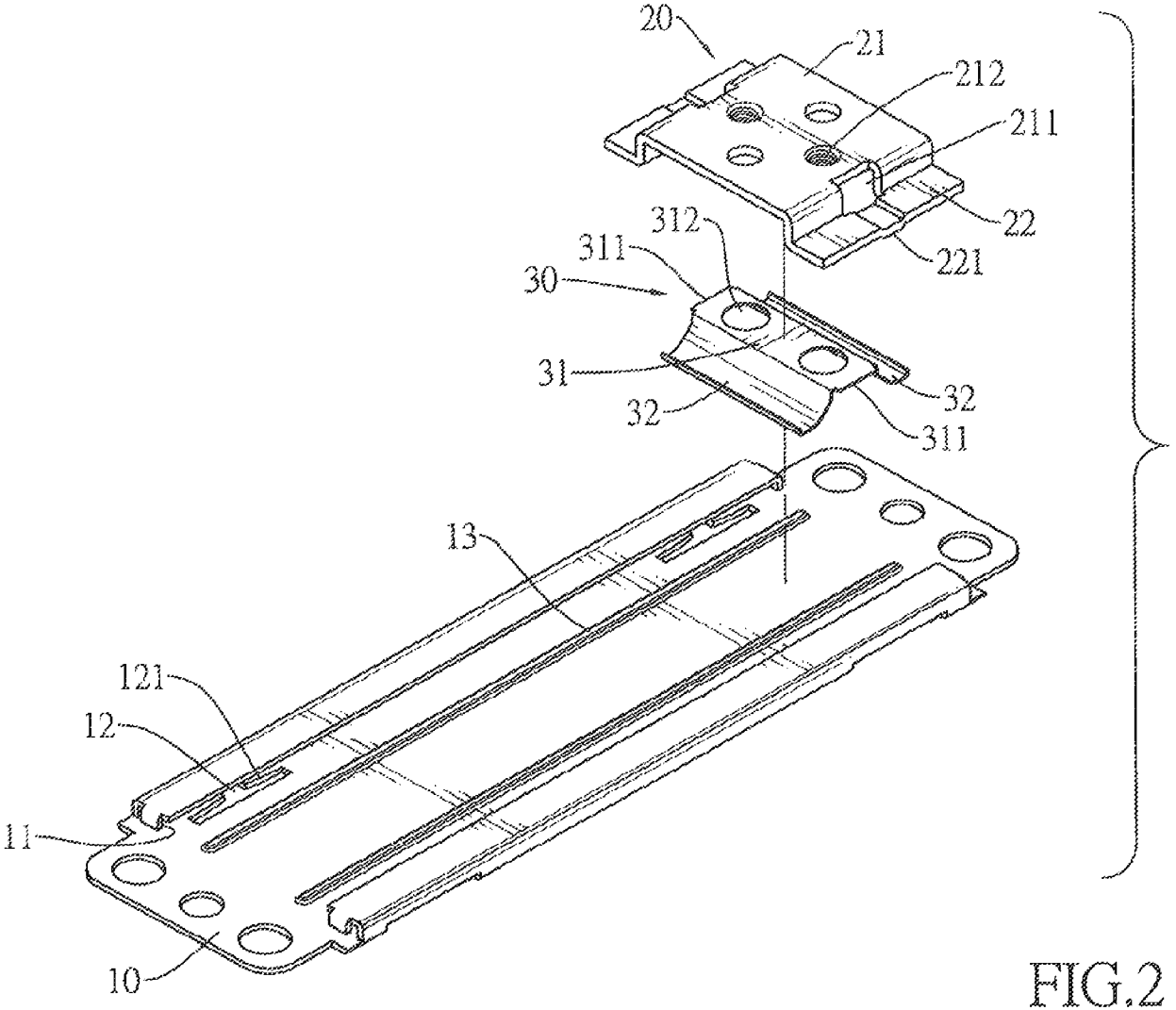
FIG. 2 is an exploded perspective view of the sliding hinge in FIG. 1.

With reference to FIGS. 1 and 2, a sliding hinge in accordance with the present invention comprises a stationary bracket (10), a sliding bracket (20) and a resilient element (30).

The stationary bracket (10) is a longitudinal bracket, and has two inside walls, a bottom, two ends, two sliding channels (11), multiple positioning holes (12) and two longitudinal ribs (13). The sliding channels (11) are formed respectively in the inside walls and are opposite to each other. The positioning holes (12) are formed separately through the bottom respectively near the ends and are formed respectively through the sidewalls. Each positioning hole (12) has two ends and two inclined protrusions (121). The inclined protrusions (121) are formed respectively on the two ends of the positioning hole (12). The longitudinal ribs (13) are formed separately on the bottom of the stationary bracket (10) and are parallel to each other.

Figure 3:
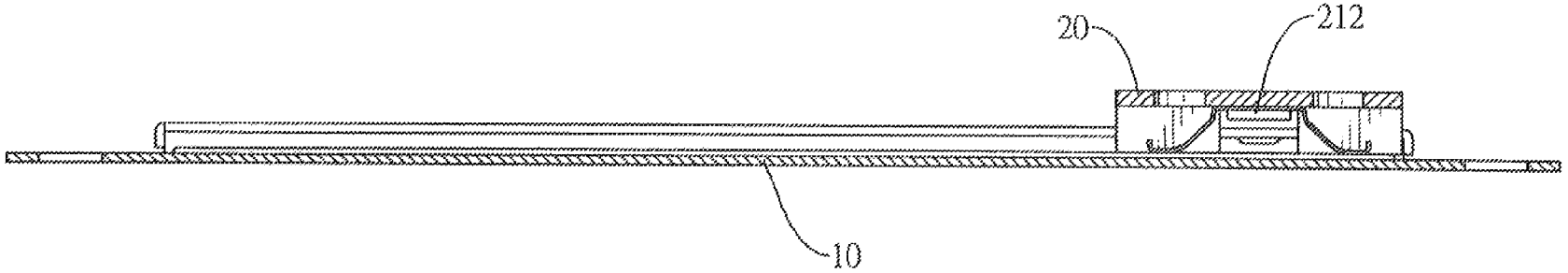
FIG. 3 is a side view in partial section of the sliding hinge in FIG. 1.
Figure 4:
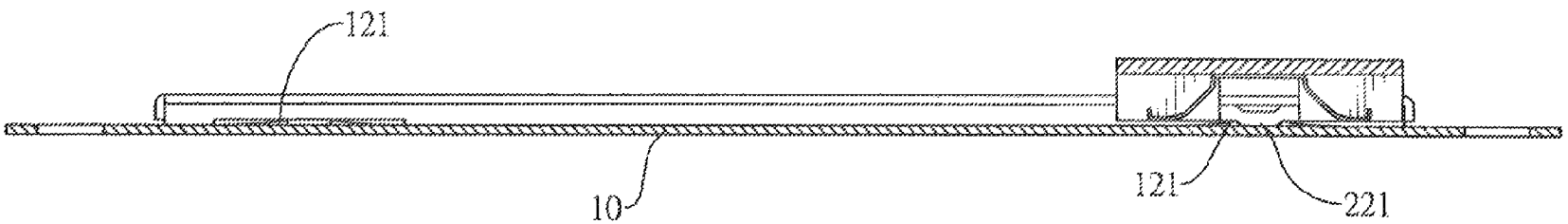
FIG. 4 is another side view in partial section of the sliding hinge in FIG. 1.
Figure 5:
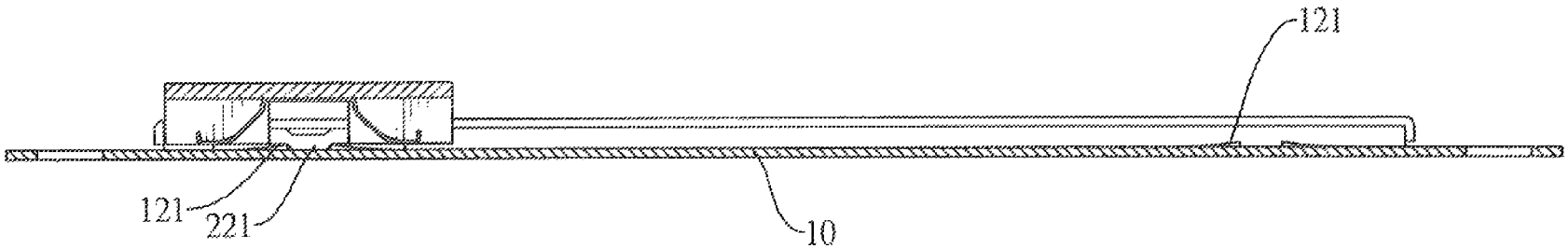
FIG. 5 is an operational side view in partial section of the sliding hinge in FIG. 1.

With further reference to FIG. 3, the sliding bracket (20) is mounted slidably on the stationary bracket (10) and has a U-shaped body (21) and two extensions (22).

The body (21) has two sidewalls, a bottom surface, two through holes (211) and two clamping protrusions (212). Each sidewall of the body (21) has a distal end. The through holes (211) are formed respectively through the sidewalls of the body (21). The clamping protrusions (212) are formed on the bottom surface of the body (21). Each clamping protrusion (212) is hollow and has internal threads.

The extensions (22) are formed on and transversely protrude out from the distal ends of the sidewalls of the body (21), are perpendicular with the sidewalls of the body (21) and are respectively mounted slidably in the sliding channels (11) of the stationary bracket (10). Each extension (22) has a bottom surface and a positioning protrusion (221). The positioning protrusion (221) is formed on and protrudes out from the bottom surface of the extension (22) and selectively engages between the corresponding inclined protrusions (121) of the stationary bracket (10) to provide positioning function.

The resilient element (30) is mounted between the stationary bracket (10) and the body (21) of the sliding bracket (20) to provide friction, connects securely to the sliding bracket (20) and has a main sheet (31) and two legs (32).

The main sheet (31) abuts the body (21) of the sliding bracket (20) and has two sides, two ends, two fastening protrusions (311) and two through holes (312). The fastening protrusions (311) are formed respectively on and protrude out from the sides of the main sheet (31) and respectively engage the through holes (211) of the sliding bracket (20) to connect the resilient element (20) securely to the sliding bracket (20). The through holes (312) are formed through the main sheet (31) and are mounted respectively around the clamping protrusions (212) of the sliding bracket (20).

The legs (32) protrude oppositely out from the ends the main sheet (31), abut the stationary bracket (10) and may respectively abut the ribs (13) of the stationary bracket (10).

When the sliding hinge as described is used, the stationary bracket (10) is connected to a base of an electronic device, and the sliding bracket (20) is connected to a cover of the electronic device. Therefore, when the cover is slid relative to the base, the sliding bracket (20) and the resilient element (30) is slid relative to the stationary bracket (10).

With the positioning holes (12) and the positioning protrusions (221) are respectively formed on the stationary bracket (10) and the sliding bracket (20), the components of the sliding hinge as described is decreased to simplify the assembling procedure. Furthermore, because the resilient element (30) directly contacts with the body (21) of the sliding bracket (20), the contacting surface is increased to increase the friction. Therefore, the cover is more easily to maintain at any desired position by the friction provided by the resilient element (30).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A sliding hinge comprising:

A stationary bracket having
- two inside walls;
- a bottom;
- two ends;
- two sliding channels being formed respectively in the inside walls and being opposite to each other; and
- multiple positioning holes being formed separately through the bottom respectively near the ends and being formed respectively through the sidewalls, and each positioning hole having
  - two ends; and
  - two inclined protrusions being formed respectively on the two ends of the positioning hole;

a sliding bracket being mounted slidably on the stationary bracket and having
- a U-shaped body having
  - two side walls, and each sidewall of the body having a distal end;
  - a bottom surface; and
  - two clamping protrustions being formed on the bottom surface of the body, and each clamping protrusion being hollow and having internal threads; and
- two extensions being formed on an transversely protruding out from the distal ends of the sidewalls of the body, being perpendicular with the sidewalls of the body and being respectively mounted slidably in the sliding channels of the stationary bracket, and each extension having
- a bottom surface; and
- a positioning protrusion being formed on and protruding out from the bottom surface of the extension and selectively engaging between corresponding inclined protrusions of the stationary bracket; and a resilient element being mounted between the stationary bracket and the body of the sliding bracket, connecting securely to the sliding bracket and having
- a main sheet abutting the body of the sliding bracket and having
  - two sides;
  - two ends; and
  - two through holes being formed through the main sheet and being mounted respectively around the clamping protrusions of the sliding bracket; and
- two legs protruding oppositely out from the ends the main sheet and abutting the stationary bracket.

2. The sliding hinge as claimed in claim 1, wherein the body of the sliding bracket has two through holes being formed respectively through the sidewalls of the body; and the main sheet of the resilient element has two fastening protrusions being formed respectively on and protruding out from the sides of the main sheet and respectively engaging through holes of the sliding bracket.

3. The sliding hinge as claimed in claim 1, wherein the stationary bracket has two longitudinal ribs being formed separately on the bottom of the stationary bracket and being parallel to each other; and the legs of the resilient element respectively abut the ribs of the stationary bracket.

4. The sliding hinge as claimed in claim 2, wherein the stationary bracket has two longitudinal ribs being formed separately on the bottom of the stationary bracket and being parallel to each other; and the legs of the resilient element respectively abut the ribs of the stationary bracket.

* * * * *